United States Patent [19]

Blandford et al.

[11] Patent Number: 4,678,031

[45] Date of Patent: Jul. 7, 1987

[54] ROTATABLE RECIPROCATING COLLAR FOR BOREHOLE CASING

[76] Inventors: David M. Blandford, 160 Sage Rd., Juniper Heights, Durango, Colo. 81301; John H. Easter, 2418 Greenbriar, Abilene, Tex. 79605

[21] Appl. No.: 823,183

[22] Filed: Jan. 27, 1986

[51] Int. Cl.[4] ..... F16L 35/00; E21B 17/14

[52] U.S. Cl. ..... 166/242; 166/285; 285/39; 285/302

[58] Field of Search ..... 285/39, 302, 347, 351; 166/242, 285, 286, 290; 175/321

[56] References Cited

U.S. PATENT DOCUMENTS

| | | | |
|---|---|---|---|
| 1,404,353 | 1/1922 | Ellis | 166/242 |
| 2,407,983 | 9/1946 | Harper | 166/21 |
| 2,533,097 | 12/1950 | Dale | 285/302 |
| 2,624,549 | 1/1953 | Wallace | 175/321 |
| 2,972,471 | 2/1961 | McClintock et al. | 285/302 |
| 3,098,667 | 7/1963 | Greenwood | 285/376 |
| 3,216,452 | 11/1965 | Williams | 137/614.13 |
| 3,492,028 | 1/1970 | Seaborn | 285/330 |
| 3,764,168 | 10/1973 | Kisling, III et al. | 285/330 |
| 3,910,349 | 10/1975 | Brown et al. | 285/302 |
| 4,105,074 | 8/1978 | Armstrong | 166/317 |
| 4,312,405 | 1/1982 | Wilder | 166/285 |
| 4,326,586 | 4/1982 | Wilder | 166/285 |
| 4,333,530 | 6/1982 | Armstrong | 166/289 |
| 4,386,796 | 6/1983 | Lyall et al. | 285/302 |
| 4,421,165 | 12/1983 | Szarka | 166/151 |
| 4,487,263 | 12/1984 | Jani | 166/289 |
| 4,502,552 | 3/1985 | Martini | 175/321 |

FOREIGN PATENT DOCUMENTS

| | | | |
|---|---|---|---|
| 226624 | 10/1958 | Australia | 285/330 |
| 572750 | 2/1958 | Italy | 285/330 |

*Primary Examiner*—Cornelius J. Husar
*Assistant Examiner*—Anthony Knight
*Attorney, Agent, or Firm*—Richards, Harris, Medlock & Andrews

[57] ABSTRACT

A rotatable reciprocating collar is provided for series connection into a borehole casing string. The collar includes a cylindrical barrel connected to one segment of the casing and a cylindrical mandrel telescopically positioned within the barrel and connected to the other segment of the casing. The mandrel has a plurality of splines projecting radially outward and the barrel has a corresponding plurality of splines projecting radially inward from its inner surface. The splines of the mandrel engage the splines of the barrel when the mandrel is telescopically extended so that the entire casing string can be rotated as a unit. After the lower segment of the casing string is fixed in place by a lower stage cementing operation, the upper segment of the casing string can be reciprocated toward the lower segment to telescopically retract the mandrel into the barrel. In the retracted position of the mandrel, the splines of the barrel and the mandrel are disengaged, thus allowing the upper segment of the casing string to be rotated and reciprocated with respect to the fixed lower segment to enhance cement bonding during the upper stage cementing operation.

9 Claims, 4 Drawing Figures

ROTATABLE RECIPROCATING COLLAR FOR BOREHOLE CASING

TECHNICAL FIELD

This invention relates to well borehole casings, and in particular, to a rotatable reciprocating collar for series connection within a borehole casing string for use during stage cementing operations.

BACKGROUND OF THE INVENTION

In preparing oil well boreholes for production, an important step is cementing a casing into place in the borehole. Primary cementing operations involved in preparing a new well for production include pumping a cement slurry down the steel casing and forcing it into the annulus between the casing and the borehole from the bottom of the well up toward the surface. Cementing a well protects and separates the various fluid producing zones from one another and protects the casing from corrosion. Cementing also lessens the danger of contaminating water supplies and helps prevent oil well blowouts and fires caused by underground high pressure zones.

During primary cementing operations, it is desirable that the outer periphery of the casing be cemented to the borehole wall along its entire length. When wells were relatively shallow, cementing was accomplished by pumping the cement slurry down the casing and back up the annulus between the casing and the borehole all the way to the surface of the well. However, in deep wells this method has proven to be unsatisfactory. As a result, a multiple stage cementing process was developed to allow the annulus to be cemented in separate stages, starting at the bottom of the well and progressing in stages up to the surface.

Multiple stage cementing is accomplished by the use of cementing tools, which are placed in the casing at one or more locations in the borehole. In the first stage of the cementing operation, cement is pumped to the bottom of the casing and up the annulus to the lowest cementing tool in the well. In the next stage of the operation, the lower portion of the casing string is closed off and cement is pumped through a valve in the cementing tool into the annulus and up to the next cementing tool in the well. Multiple stages of cementing are completed in this manner up to the surface of the well.

During primary cementing operations it is desirable that the casing string be rotated and/or reciprocated to enhance cement bonding between the casing and the borehole wall. If the casing is not rotated and/or reciprocated while the cement is being forced into the annulus, poor bonding is likely to result. During the first stage of cementing, the entire casing string can be rotated and/or reciprocated while the cement is pumped into the annulus. However, after the first stage of cementing is complete and the casing string is fixed in place, further rotation and/or reciprocation of the casing string generally becomes impossible. Thus, there is a need for a device which allows rotation and/or reciprocation of the upper casing string after the lower casing string has been cemented in place in a multiple stage cementing operation.

SUMMARY OF THE INVENTION

The present invention is a rotatable reciprocating collar designed for series connection within a borehole casing string. The collar may be used with any multiple stage cementing tool to enhance cement bonding by allowing rotation and/or reciprocation of the upper portion of the casing string after the lower portion of the string has been cemented in place. The collar remains down hole as an integral part of the casing string after the stage cementing operation has been completed.

The collar of the present invention includes a cylindrical barrel, which is connected to one segment of the casing, and a cylindrical mandrel, which is connected to the other segment of the casing and which reciprocates telescopically within the barrel. The mandrel has a plurality of splines projecting radially outward from the end of the mandrel disposed within the barrel. The barrel has a corresponding plurality of splines projecting radially inward from its inner surface. The splines of the mandrel engage the splines of the barrel when the mandrel is telescopically extended. The barrel includes a stop for contacting the mandrel splines to prevent the mandrel from extending beyond a predetermined limit and separating from the barrel. When the splines of the mandrel and the barrel are engaged, the entire casing string joined by the collar can be rotated only as a unit. The casing string and the collar are kept in tension while placing the casing down the borehole and during all cementing operations at lower stages so that the mandrel remains extended, the mandrel and barrel splines remain engaged, and the entire casing string remains rotatable only as a unit.

The rotatable reciprocating collar is normally placed immediately above or below the stage cementing tool in the casing string. When cementing operations have been completed up to a level near the stage cementing tool, the tension on the casing string can be reduced so that the upper segment of the string moves toward the fixed lower segment of the string as the mandrel telescopes into the barrel of the collar. With the mandrel telescoped into the barrel, the mandrel and barrel splines disengage so that the upper segment of the casing string may be rotated with respect to the lower segment. Thus, as cement is forced through the cementing tool at this stage of the cementing operation, the upper casing string may be rotated and/or reciprocated to enhance cement bonding between the borehole wall and the upper stage of the casing string. Both the mandrel and the barrel are provided with O-ring seals so that the casing pipe remains sealed at all times. The collar is normally returned to its extended position to engage the splines as the cement sets. Thus, the collar remains down hole as an integral part of the casing string after cementing operations have been completed.

The rotatable reciprocating collar of the present invention may be used with any stage cementing tool presently available. The collar may be manufactured in any size to accommodate the diameter of the casing used in the borehole. Casing pipe adapters may be provided for either or both the mandrel and the barrel to facilitate connection to the casing pipe. Further, the length of the barrel and the mandrel may be made sufficiently long to allow for substantial reciprocating movement of the upper casing string within the borehole.

BRIEF DESCRIPTION OF THE DRAWINGS

For a more complete understanding of the present invention and for further advantages thereof, reference is now made to the following Description of the Preferred Embodiment taken in conjunction with the accompanying Drawings, in which.

DESCRIPTION OF THE PREFERRED EMBODIMENT

Figure 1:
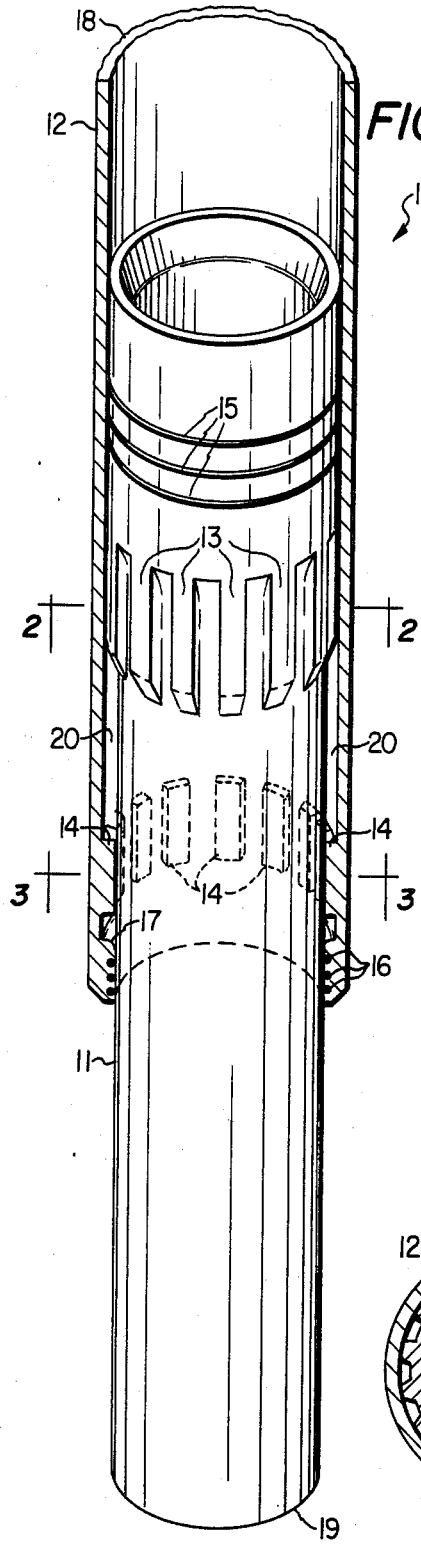
FIG. 1 is a cutaway perspective view of the present invention showing the barrel and the mandrel positioned with their splines disengaged.

Referring to FIG. 1, reference numeral 10 generally identifies the rotatable reciprocating collar of the present invention. Collar 10 includes a barrel 12 and a mandrel 11. Barrel 12 is an open ended cylinder which attaches at end 18 to one segment of a well borehole casing pipe string. Mandrel 11 is an open ended cylinder telescopically inserted into barrel 12. Mandrel 11 is connected at end 19 to the other segment of the casing pipe string.

Figure 2:
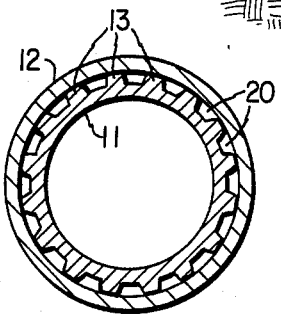
FIG. 2 is a cross-sectional diagram of the present invention taken at the section 2—2 of FIG. 1.
Figure 3:
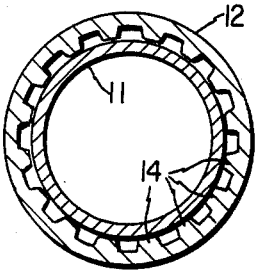
FIG. 3 is a cross-sectional diagram of the present invention taken at section 3—3 of FIG. 1.

Mandrel 11 includes a plurality of mandrel splines 13 projecting radially outward from the end of mandrel 11 inserted into barrel 12. The splines 13 of mandrel 11 are more clearly illustrated in the cross-sectional diagram of FIG. 2. Barrel 12 includes a corresponding plurality of barrel splines 14 projecting radially inward from the end of barrel 12 remote from the end 18 connected to the casing string. Splines 14 of barrel 12 are more clearly illustrated in the cross-sectional diagram of FIG. 3.

Mandrel 11 includes O-ring seals 15, and barrel 12 includes O-ring seals 16. O-ring seals 15 and 16 maintain a seal between the interior and exterior of collar 10 as mandrel 11 rotates and/or reciprocates longitudinally with respect to barrel 12.

O-ring seals 15 and 16 provide an additional advantage during use of collar 10. When collar 10 is formed by inserting mandrel 11 into barrel 12, the O-ring seals 15 and 16 form an air-tight seal. Thus, when collar 10 is fully extended, the air space 20 between seals 15 and 16 is compressed to as much as 3,000 p.s.i. This air pressure does not leak off. During use of collar 10, the air pressure assists in retracting mandrel 11 into barrel 12, thus relieving part of the load on the associated oilwell machinery.

During placement of the casing string into the borehole and during all cementing operations occurring below the level of the collar 10, the casing string is under tension so that mandrel 11 is fully extended with respect to barrel 12. Barrel 12 includes a stop 17 for contacting mandrel splines 13 to limit the extension of mandrel 11 and prevent it from separating from barrel 12 while the collar 10 is under tension. In the fully extended position, splines 13 of mandrel 11 engage splines 14 of barrel 12 so that the upper and lower casing strings can be rotated only as a unit.

Figure 4:
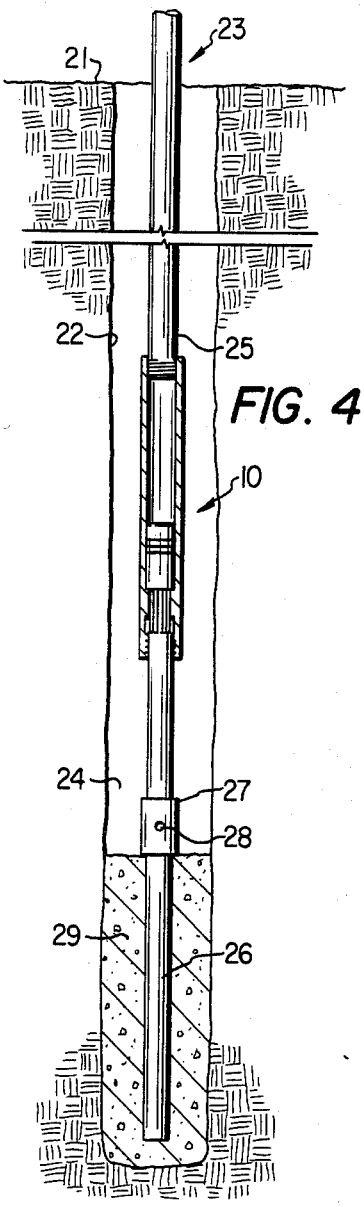
FIG. 4 is a longitudinal sectional diagram of a well borehole illustrating the present invention connected within a casing pipe string.

As illustrated in FIG. 4, during the first stage of a multistage cementing operation, cement 29 is forced out the bottom of the casing pipe 23 and into the annulus 24 between the borehole 22 and the casing pipe 23 up to the level of the lowest cementing tool 27 in the casing pipe 23. Normally, collar 10 is positioned immediately above or below the cementing tool 27 in the casing string. After the first stage of cementing is complete and cement 29 has set, the lower segment 26 of the casing string is fixed within the borehole 22 by cement 29. At this point in the cementing operation cement 29 supports the weight of lower segment 26, including mandrel 11 which is rigidly attached to lower segment 26 at end 19, thus allowing the upper segment 25 of the casing string to be lowered with respect to the lower segment 26. Barrel 12, which is rigidly attached to the upper segment 25 at end 18, is lowered with respect to mandrel 11 a distance greater than the length of splines 13 and 14 so that mandrel 11 telescopes into barrel 12 and splines 13 and 14 become disengaged. In the next stage of the cementing operation, the lower segment 26 of the casing is blocked and cement is forced through a valve port 28 in the cementing tool 27 and into the annulus 24 around the upper segment 25 of the casing string. As long as the splines 13 and 14 of collar 10 remain disengaged during this stage of cementing, the upper segment 25 of the casing string may be reciprocated and/or rotated with respect to the lower segment 26 of the casing string, which is fixed in place by hardened cement 29. Before the upper stage cement is allowed to set, splines 13 and 14 of collar 10 are normally reengaged by providing tension to the upper segment 25 of the casing string so that mandrel 11 and barrel 12 are telescoped to their fully extended length. Thus, collar 10 remains an integral part of the casing string after cementing has been completed up to the surface 21 of the well borehole 22.

The rotatable reciprocating collar 10 of the present invention can be oriented with the barrel 12 uppermost and attached to the upper segment 25 or with the barrel 12 lowermost and attached to the lower segment 26 but collar 10 is normally oriented with the barrel in the uppermost position shown in FIG. 1. The collar 10 of the present invention can be manufactured in any size to accommodate any diameter casing used in the borehole. A casing adapter may be provided for either or both the mandrel and the barrel to facilitate connection to the casing pipe or the cementing tool 27. The collar 10 is also designed to be used with any presently available cementing tool. Further, the length of the barrel 12 and the mandrel 11 can be made sufficiently long to allow for adequate longitudinal reciprocation of the mandrel 11 with respect to the barrel 12 to enhance cement bonding between the casing string and the borehole wall.

Although the present invention has been described with respect to a specific preferred embodiment thereof, various changes and modifications may be suggested to one skilled in the art, and it is intended that the present invention encompass such changes and modifications as fall within the scope of the appended claims.

We claim:

1. A rotatable reciprocating collar for series connection into a borehole casing string between an upper segment and a lower segment of the casing string to assist in a multistage cementing operation, means being provided for passing cement from the interior of the casing string to the annulus between the casing string and borehole proximate the collar, comprising:

an open cylindrical barrel having a first barrel end, a second barrel end, and an inner surface;

a plurality of barrel splines projecting radially inward from said inner surface at said first barrel end;

an open cylindrical mandrel having a first mandrel end, a second mandrel end, and an outer surface;

a plurality of mandrel splines projecting radially outward from said outer surface at said first mandrel end;

said mandrel slidably disposed within said barrel such that said second mandrel end is telescopically extendable from said first barrel end;

wherein said mandrel splines engage said barrel splines when said second mandrel end is telescopically extended from said first barrel end and said mandrel splines disengage said barrel splines when said mandrel is telescopically retracted into said barrel; and said second barrel end being connected to one of said segments of the casing string and the second mandrel end being connected to the other of said segments to permit rotation and reciprocation of the upper segment relative to the lower segment during a multistage cementing operation, the collar remaining permanently within the borehole after cementing to form a portion of the casing.

2. The rotatable reciprocating collar of claim 1, wherein said second barrel end is connected to a first segment of the casing string and said second mandrel end is connected to a second segment of the casing string.

3. The rotatable reciprocating collar of claim 2, wherein said first segment of the casing string is an upper segment and said second segment is a lower segment.

4. The rotatable reciprocating collar of claim 1, wherein said barrel includes at least one O-ring seal disposed against said outer surface of said mandrel and said mandrel includes at least one O-ring seal disposed against said inner surface of said barrel, said O-ring seals maintaining a seal during rotation and reciprocation of said mandrel with respect to said barrel.

5. The rotatable reciprocating collar of claim 1, wherein said barrel includes a stop for contacting said mandrel splines to prevent telescopic extension of said mandrel from said barrel beyond a predetermined limit.

6. The rotatable reciprocating collar of claim 1, wherein engagement of said mandrel and barrel splines prevents rotation of said mandrel with respect to said barrel.

7. The rotatable reciprocating collar of claim 1, wherein disengagement of said mandrel and barrel splines allows rotation and reciprocation of said mandrel with respect to said barrel.

8. A rotatable reciprocating collar for series connection into a borehole casing string between an upper segment and a lower segment of the casing string to assist in a multistage cementing operation, means being provided for passing cement from the interior of the casing string to the annulus between the casing string and borehole proximate the collar, comprising:

a cylindrical barrel having an open connection end, an open collar end, and an inner surface, said connection end connectable to one of said segments of the casing string;

a plurality of barrel splines projecting radially inward from said inner surface at said collar end;

a cylindrical mandrel having first and second open ends and an outer surface, said second end connectable to the other of said segments of the casing string and said first end telescopically positioned within said collar end of said barrel;

a plurality of mandrel splines projecting radially outward from said outer surface at said first end such that said mandrel splines engage said barrel splines when said mandrel is extended from said barrel, thereby preventing rotation of said mandrel with respect to said barrel, and said mandrel splines disengage said barrel splines when said mandrel is retracted into said barrel, thereby allowing rotation of said mandrel with respect to said barrel;

a stop attached to said barrel for contacting said mandrel splines to prevent extension of said mandrel from said barrel beyond a predetermined limit;

a first O-ring seal disposed between said collar end of said barrel and said outer surface of said mandrel and a second O-ring seal disposed between said first end of said mandrel and said inner surface of said barrel, said seals maintaining a seal during rotation and reciprocation of said mandrel with respect to said barrel; and said mandrel splines engaging said barrel splines when said casing string is being cemented below said collar to permit simultaneous rotation and reciprocation of both upper and lower segments of the casing string, said mandrel splines disengaging said barrel splines when cement is passing through said means for passing cement between the interior of the casing string and the annulus proximate the collar subsequent to cementing of the lower segment within the borehole to permit independent reciprocation and rotation of the upper segment relative to the lower segment to enhance the cementing of the upper segment within the borehole, said collar being permanently cemented within the borehole.

9. A borehole casing string for facilitating a multistage cementing operation, comprising:

an upper casing string segment;

a lower casing string segment;

a rotatable reciprocating collar connecting said upper and lower segments, said collar comprising:

an open cylindrical barrel having a first barrel end, a second barrel end and an inner surface;

a plurality of barrel splines projecting radially inward from said inner surface at said first barrel end;

an open cylindrical mandrel having a first mandrel end, a second mandrel end, and an outer surface;

a plurality of mandrel splines projecting radially outward from said outer surface at said first mandrel end;

said mandrel slidably disposed within said barrel such that said second mandrel end is telescopically extendable from said first barrel end;

wherein said mandrel splines engage said barrel splines when said second mandrel end is telescopically extended from said first barrel end and said mandrel splines disengage said barrel splines when said mandrel is telescopically retracted into said barrel;

said second barrel end being connected to one of said segments of the casing string and the second mandrel end being connected to the other of said segments;

means for passing cement from the interior of the casing string to the annulus between the casing string and borehole proximate the collar; and said mandrel splines engaging said barrel splines when cementing the lower segment within the borehole to permit simultaneous rotation and reciprocation of the entire casing string and said mandrel splines being disengaged from said barrel splines when cement passes through said means for cementing the upper segment within the borehole subsequent to cementing of the lower segment, thereby permitting the upper segment to be reciprocated and rotated to facilitate the cementing operation independent of the lower segment.

* * * * *